US005394729A

United States Patent [19]

Eisenhower, Jr.

[11] Patent Number: 5,394,729

[45] Date of Patent: Mar. 7, 1995

[54] SHEET METAL BENDING TOOL

[76] Inventor: Gary W. Eisenhower, Jr., 463 North Trunck, Freeport, Ill. 61032

[21] Appl. No.: 113,331

[22] Filed: Aug. 30, 1993

[51] Int. Cl.[6] ..... B21D 3/10

[52] U.S. Cl. ..... 72/458

[58] Field of Search ..... 72/457, 458

[56] References Cited

U.S. PATENT DOCUMENTS

| | | | |
|---|---|---|---|
| 1,286,488 | 12/1918 | Amberg | 72/458 |
| 1,324,693 | 12/1919 | Rush | 72/458 |
| 1,581,119 | 4/1926 | Herring | 72/458 |
| 1,879,583 | 9/1932 | Stowell | 72/458 |
| 2,744,427 | 5/1956 | Albert | 72/458 |

*Primary Examiner*—David Jones
*Attorney, Agent, or Firm*—Hugh E. Smith

[57] ABSTRACT

A sheet metal bending tool for prying and bending sheet metal flanges such as those found on vehicle doors, air conditioning duct work, and the like. The tool includes a handle having a pair of flange engaging jaws at opposed ends thereof in which a first jaw is positioned at a right angle to the handle and a second jaw is positioned colinearly with the handle. Alternate embodiments of the present invention include a third jaw positioned adjacent to the first jaw and an angle adjustment assembly for facilitating an adjustment of the relative angle between one of the jaws and the handle.

3 Claims, 4 Drawing Sheets

SHEET METAL BENDING TOOL

BACKGROUND OF THE INVENTION

1. Field of the Invention

The present invention relates to tools and more particularly pertains to a sheet metal bending tools for prying and bending sheet metal flanges such as those found on vehicle doors, air conditioning duct work, and the like.

2. Description of the Prior Art

The use of tools is known in the prior art. More specifically, tools heretofore devised and utilized for the purpose of bending metal are known to consist basically of familiar, expected and obvious structural configurations, notwithstanding the myriad of designs encompassed by the crowded prior art which have been developed for the fulfillment of countless objectives and requirements.

For example, an adjustable leverage pry bar is illustrated in U.S. Pat. No. 4,042,210 having a lever including a handle portion and a pry portion connected to the handle portion and in the form of an arcuate plate provided with a claw. A fulcrum member is mounted on the pry portion and is movable along the arcuate plate between the claw and the handle portion to effectively vary the angle and amount of leverage exerted by the lever.

Another patent of interest is U.S. Pat. No. 3,687,834 which discloses a pry bar and nail puller comprising an elongated steel bar having a hook shaped at one end and a nail puller at the opposite end. The elongated steel bar is slightly angled at the latter end and forked so as to form the nail puller.

While these devices fulfill their respective, particular objectives and requirements, the aforementioned patents do not disclose a sheet metal bending tool for prying and bending sheet metal flanges that includes a handle having a pair of flange engaging jaws at opposed ends thereof in which a first jaw is positioned at a right angle to the handle and a second jaw is positioned colinearly with the handle. Furthermore, none of the known prior art tools disclose a sheet metal bending tool having an angle adjustment assembly for facilitating an adjustment of the relative angle between one of the jaws and the handle.

In these respects, the sheet metal bending tool according to the present invention substantially departs from the conventional concepts and designs of the prior art, and in so doing provides an apparatus primarily developed for the purpose of prying and bending sheet metal flanges such as those found on vehicle doors, air conditioning duct work, and the like.

SUMMARY OF THE INVENTION

In view of the foregoing disadvantages inherent in the known types of tools now present in the prior art, the present invention provides a new sheet metal bending tool construction wherein the same can be utilized for prying and bending sheet metal flanges. As such, the general purpose of the present invention, which will be described subsequently in greater detail, is to provide a new sheet metal bending tool apparatus which has many of the advantages of the tools mentioned heretofore and many novel features that result in a sheet metal bending tool which is not anticipated, rendered obvious, suggested, or even implied by any of the prior art tools, either alone or in any combination thereof.

To attain this, the present invention essentially comprises a sheet metal bending tool for prying and bending sheet metal flanges such as those found on vehicle doors, air conditioning duct work, and the like. The tool includes a handle having a pair of flange engaging jaws at opposed ends thereof in which a first jaw is positioned at a right angle to the handle and a second jaw is positioned colinearly with the handle. Alternate embodiments of the present invention include a third jaw positioned adjacent to the first jaw and an angle adjustment assembly for facilitating an adjustment of the relative angle between one of the jaws and the handle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sheet metal bending tool apparatus which has many of the advantages of the tools mentioned heretofore and many novel features that result in a sheet metal bending tool which is not anticipated, rendered obvious, suggested, or even implied by any of the prior art tools, either alone or in any combination thereof.

It is another object of the present invention to provide a new sheet metal bending tool which may be easily and efficiently manufactured and marketed.

It is a further object of the present invention to provide a new sheet metal bending tool which is of a durable and reliable construction.

An even further object of the present invention is to provide a new sheet metal bending tool which is susceptible of a low cost of manufacture with regard to both materials and labor, and which accordingly is then susceptible of low prices of sale to the consuming public, thereby making such sheet metal bending tools economically available to the buying public.

Still yet another object of the present invention is to provide a new sheet metal bending tool which provides in the apparatuses and methods of the prior art some of the advantages thereof, while simultaneously overcoming some of the disadvantages normally associated therewith.

Still another object of the present invention is to provide a new sheet metal bending tool for prying and bending sheet metal flanges such as those found on vehicle doors, air conditioning duct work, and the like.

Yet another object of the present invention is to provide a new sheet metal bending tool that includes a handle having a pair of flange engaging jaws at opposed ends thereof in which a first jaw is positioned at a right angle to the handle and a second jaw is positioned colinearly with the handle.

Even still another object of the present invention is to provide a new sheet metal bending tool that includes a handle having a plurality of flange engaging jaws in which a first jaw is positioned at a right angle to the handle, a second jaw is positioned colinearly with the handle, and a third jaw is positioned adjacent to the first jaw.

Even still yet another object of the present invention is to provide a new sheet metal bending tool having an angle adjustment assembly for facilitating an adjustment of the relative angle between one of the jaws and the handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
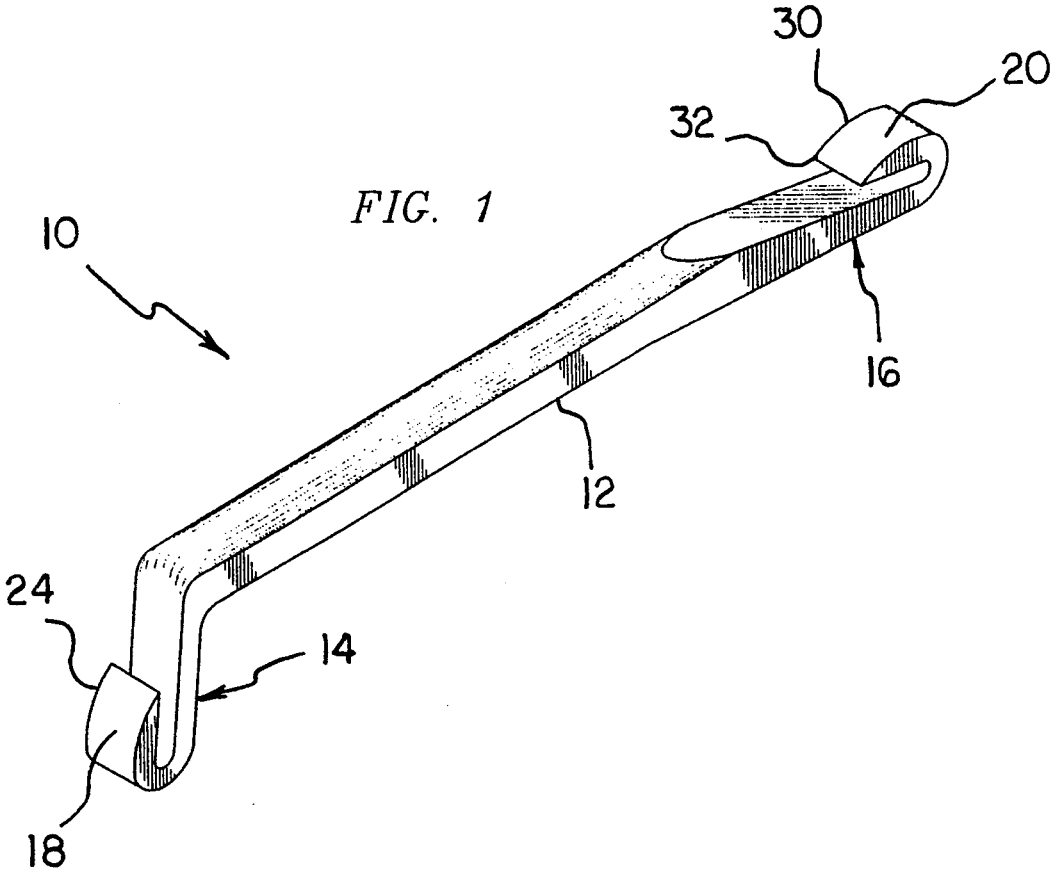
FIG. 1 is a perspective view of a sheet metal bending tool comprising the present invention.

With reference now to the drawings, and in particular to FIGS. 1–4 thereof, a first embodiment of a sheet metal bending tool embodying the principles and concepts of the present invention and generally designated by the reference numeral 10 will be described.

The sheet metal bending tool 10 includes a handle 12 having a first jaw 14 at a first end and a second jaw 16 at a second end thereof. The first jaw 14 is integrally or otherwise connected to the handle 12 at a substantially right-angle. The second jaw 16 is integrally or otherwise connected to the handle 12 in a substantially colinear manner. The jaws 14, 16 include a first jaw tip 18 and a second jaw tip 20, respectively, as best illustrated in FIG. 1. The tips 18, 20 of the jaws 14, 16 are operable to be positioned beneath a flange of a work-piece whereby a user may apply a prying force to deform such a flange. The sheet metal bending tool 10 is particularly suited for prying and bending sheet metal flanges such as those found on vehicle doors, air conditioning duct work, and the like.

More specifically, it will be noted that the sheet metal bending tool 10 comprises a substantially straight handle 12 having first and second respectively opposed ends. A first jaw 14 is integrally or otherwise formed at a first end of the handle 12 at an angle designated by the reference character $A_1$ of approximately 90 degrees. A second jaw 16 is integrally or otherwise formed at the second end of the handle 12 at an angle designated by the reference character $A_2$ and equal to approximately 180 degrees. Although the angles $A_1$, $A_2$ have been described as being equal to 90 degrees and 180 degrees, respectively, it should be understood that the first and second jaws 14, 16 may be positioned at any angle relative to the handle 12. However, the preferred embodiment of the invention desires the angle $A_1$ between the first jaw 14 and the handle 12 to be equivalent to approximately 94 degrees and the second angle $A_2$ between the second jaw 16 and the handle to be equivalent to approximately 170 degrees.

Figure 2:
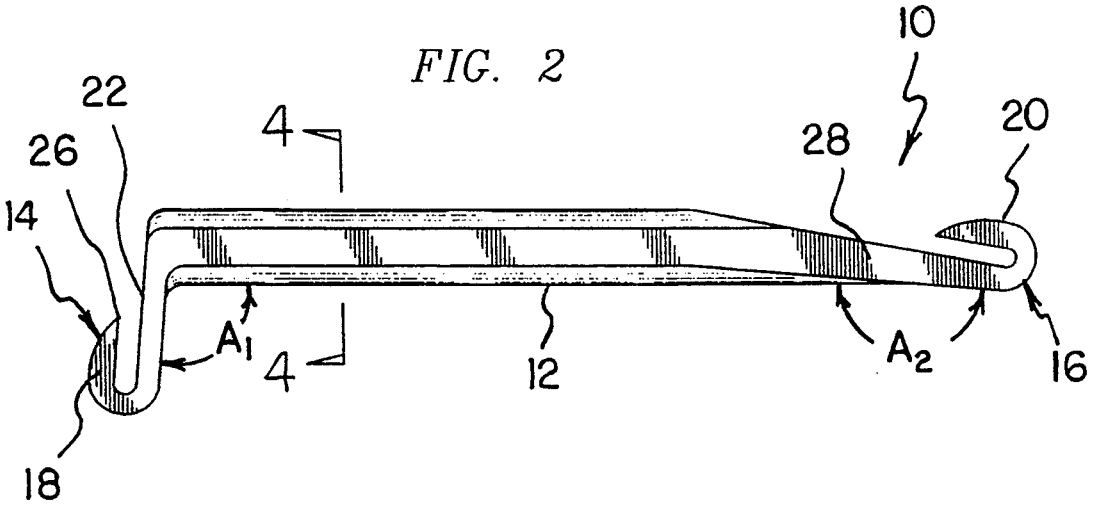
FIG. 2 is a side elevation view of the present invention.

With reference to FIGS. 1 and 2, it can be shown that the first jaw 14 comprises a first jaw leg 22 which is integrally formed from a reduced cross section area of the handle 12 formed at the preferred angle $A_1$ with respect thereto. The first jaw leg 22 extends away from the handle 12 and is folded back upon itself to define the first jaw tip 18. The first jaw tip 18 is positioned substantially parallel to the first jaw leg 22 and is formed in such a manner so as to define a tapered edge 24 which terminates at a first jaw point 26. An unlabeled distance between the first jaw tip 18 and the first jaw leg 22 should be of sufficient breadth to allow a portion of a flange to enter.

Similarly, the second jaw 16 is formed from a reduced cross sectional area of the handle 12 which defines a second jaw leg 28 projecting from the handle at the preferred angle $A_2$ of approximately 170 degrees. The second jaw leg 28 continues to taper until it is folded upon itself to define the second jaw tip 20 having a tapered edge 30 terminating at a second jaw point 32. The second jaw tip 20 is also sufficiently spaced from the second jaw leg 28 so as to allow a positioning of a flange therebetween.

Figure 4:
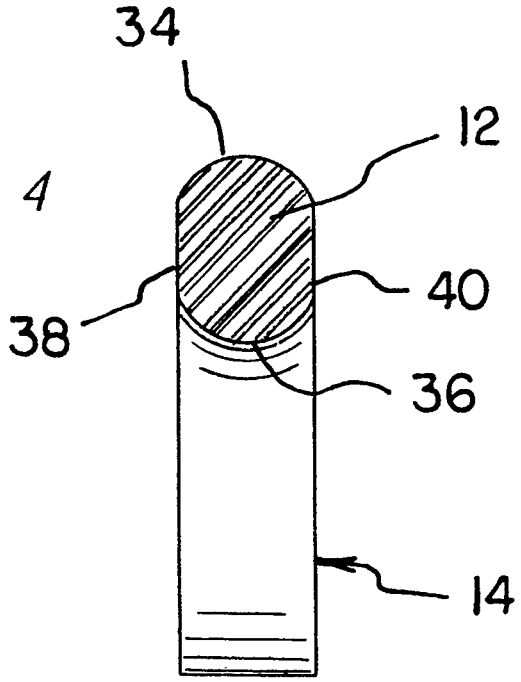
FIG. 4 is a cross section view taken along line 4—4 of FIG. 2.

FIG. 4 details a cross section of the handle 12 and it can be seen from this Figure that the handle includes a round top area 34 and a round bottom area 36 which are both operable to provide a comfortable gripping surface for the user. In addition, the handle 12 includes a pair of flat sides 38, 40 which may be utilized by the user for hammering purposes. Although the handle 12 has been described as having a particular cross section, it should be understood that any conceivable cross section may be utilized in constructing the tool 10.

Figure 3:
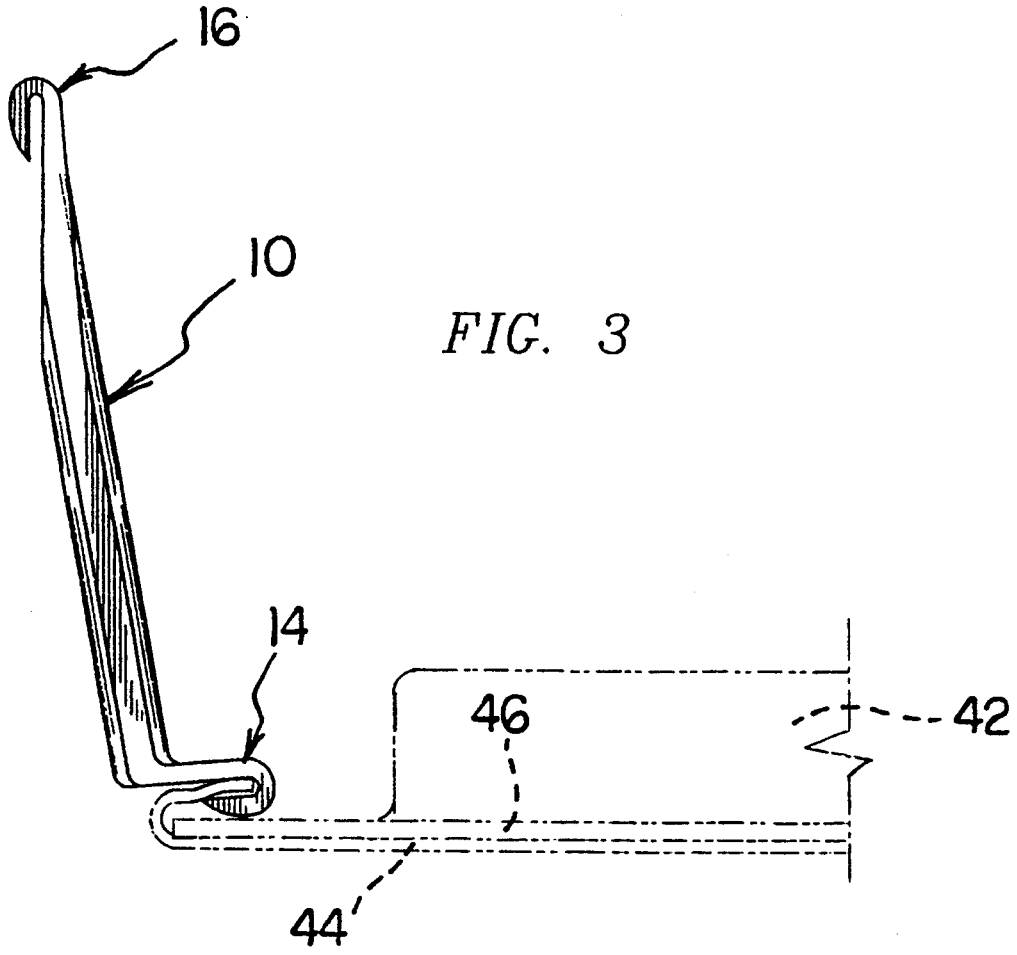
FIG. 3 is a further side elevation view of the invention detailing its intended use.

FIG. 3 illustrates one of a number of uses of the sheet metal bending tool 10. The sheet metal bending tool 10 is particularly suited for prying and bending sheet metal flanges such as those found on a vehicle door 42 during a removal of the door skin 44 from the door frame 46. To remove the door skin 44 from the door frame 46, spot welts connecting the two together must be drilled out in a conventional manner. The sheet metal bending tool 10 may then be positioned in such a manner so as to capture a portion of the flange within either of the jaws 14, 16. A prying force may be applied by the user to deform the flange so as to allow the door skin 44 to be removed from the door frame 46. Because the first and second jaws 14, 16 are positioned at different angles with respect to the handle 12, the sheet metal bending tool 10 may be easily engaged to the flange, even in tight or restricted areas. Although the sheet metal bending tool 10 has been described as being utilized to remove the sheet metal door skin from a vehicle door, the tool may be utilized for bending metal or other materials of any configuration or construction.

Figure 5:
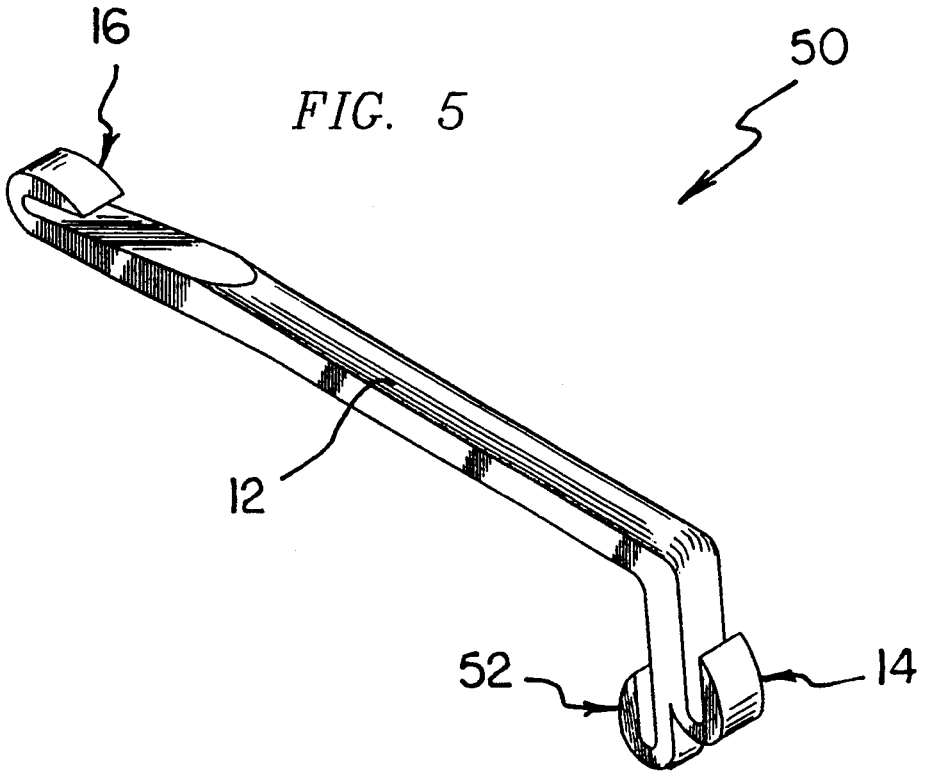
FIG. 5 is a perspective view of a second embodiment of a sheet metal bending tool comprising the present invention.
Figure 6:
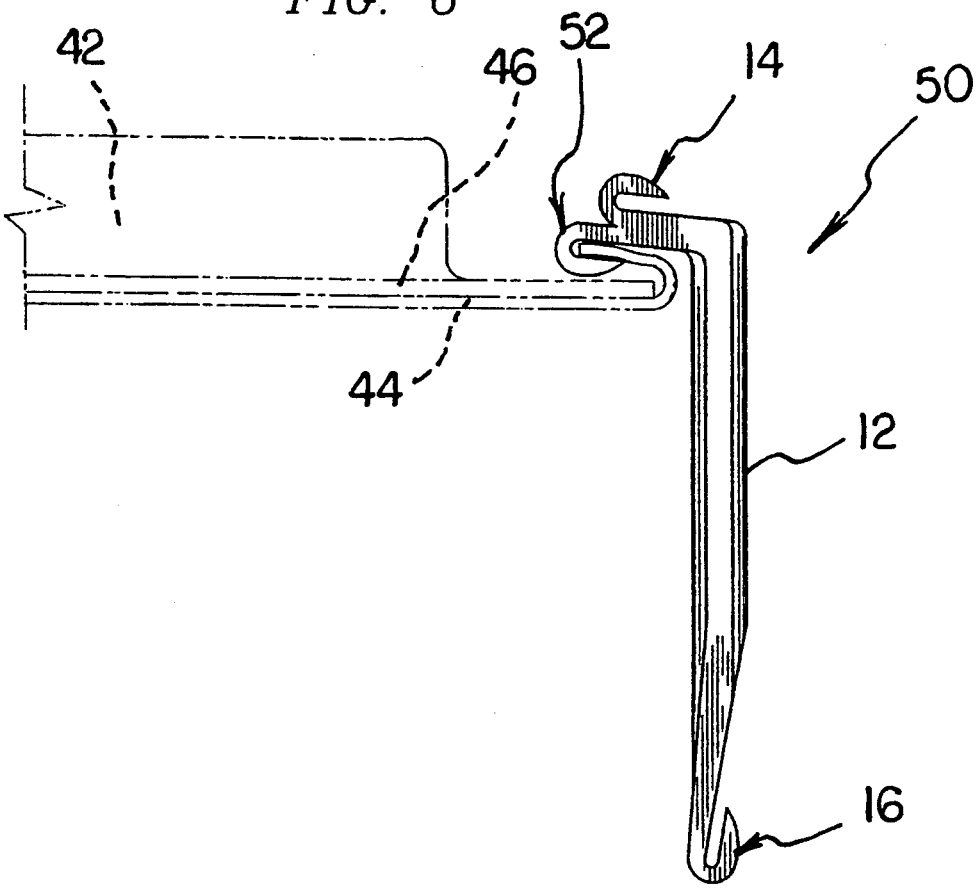
FIG. 6 is a side elevation view of the second embodiment of the invention.

A second embodiment of the present invention as generally designated by the reference numeral 50, which comprises substantially all of the features of the foregoing embodiment 10 and which further comprises a third jaw 52 will now be described. As best shown in FIGS. 5–6, it can be shown that the third jaw 52 is integrally or otherwise formed immediately adjacent to the first jaw 14. The third jaw 52 is formed in such a manner so as to face in an opposite direction as that of the first jaw 14 to provide an additional position in which the sheet metal bending tool 10 may be utilized. In addition, the third jaw 52 is positioned slightly farther away from the handle 12 than the first jaw 14, as best illustrated in FIG. 6. The third jaw 52 is of a similar construction as that of the first and second jaws 14, 16 and, therefore, a detailed description of its construction will not be provided. Although not illustrated, the second embodiment 50 may also include a fourth jaw located immediately adjacent to and facing away from the second jaw 16. Alternatively, the number of jaws may be limited to three, with the third jaw 52 being positioned adjacent to the second jaw 16.

Figure 7:
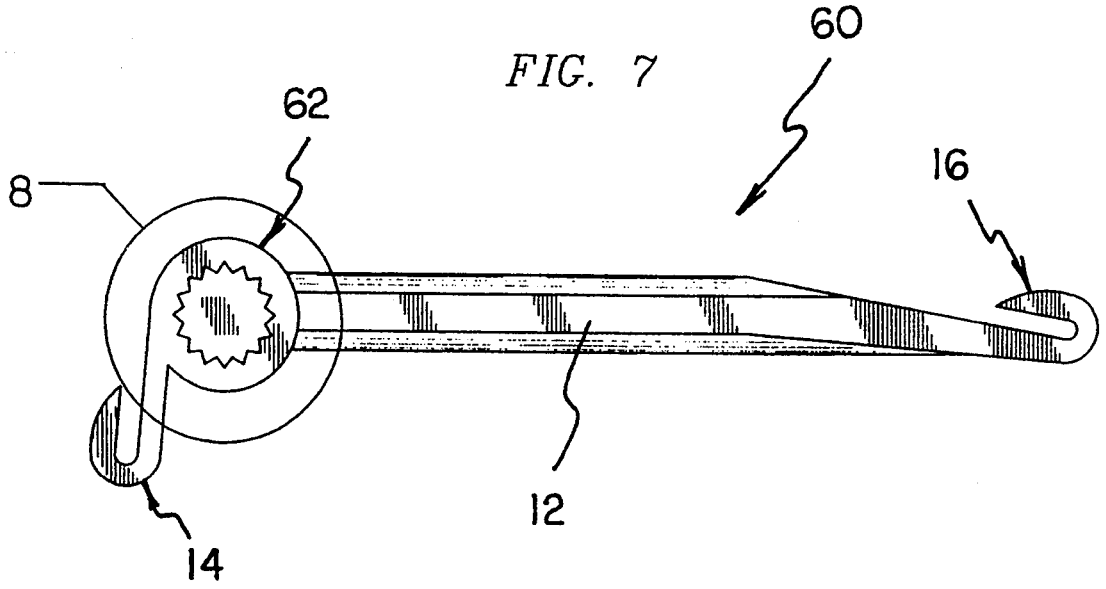
FIG. 7 is a side elevation view of third embodiment of a sheet metal bending tool comprising the present invention.
Figure 8:
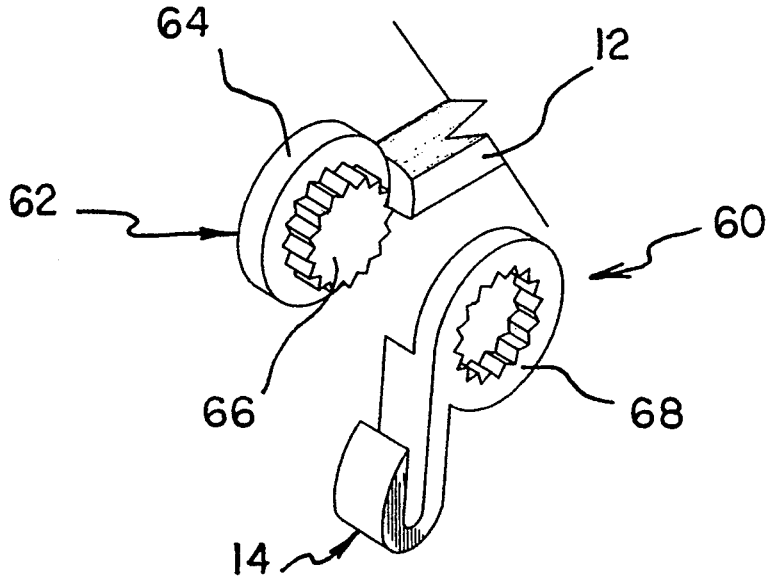
FIG. 8 is a perspective view of a portion of the third embodiment as indicated by the circled area of FIG. 7.

Comprising substantially all of the features and structure of the previous embodiments 10, 50 is a third embodiment which is generally designated by the reference numeral 60 and may be viewed in FIGS. 7–8. It can be shown that the third embodiment 60 further comprises an angle adjustment assembly 62 which allows the angle $A_1$ between the first jaw 14 and the handle 12 to be adjusted to any desired angle. FIG. 8 details a construction of the angle adjustment assembly 62 and it can be seen from this Figure that the same comprises a circular member 64 which is integrally or otherwise formed into the first end of the handle 12. A toothed projection 66 is positioned in a center area of the circular member 64 and is operable to engage a socket 68 forming an integral portion of the first jaw 14. By this structure, the first jaw 14 may be positioned at any one of a number of angles with respect to the handle 12. In the preferred embodiment, the toothed projection 66 allows the first jaw 14 to be positioned at sixteen different angles. However, the toothed projection 66 and the socket 68 may be constructed in a manner which provides any number of conceivable angles between the jaw 14 and the handle 12. In addition, another angle adjustment assembly 62 may be utilized for connecting the second jaw 16 to the handle 12 so as to provide an adjustment of the angle $A_2$ therebetween. The angle adjustment assembly 62 allows a user to select an angle which facilitates a use of the sheet metal bending tool 10 within extremely tight and limited areas.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new sheet metal bending tool comprising:

a handle having respectively opposed first and second ends, said handle comprising a respectively opposed round top area and round bottom area, and a respectively opposed pair of flat sides, said pair of flat sides being operable to impact and deform said flange;

a first jaw member fixedly secured to said first end of said handle, wherein said first jaw member is oriented at an oblique angle relative to said handle, said first jaw member comprising a first jaw leg folded upon itself to define a first jaw tip in a parallel, spaced relationship to said first jaw leg so as to receive at least a portion of said flange therebetween, said first jaw tip being formed in such a manner so as to define a first tapered edge which terminates at a first jaw point; and;

a second jaw member fixedly secured to said second end of said handle, wherein said second jaw member is oriented at an oblique angle relative to said handle, said second jaw member comprising a second jaw leg folded upon itself to define a second jaw tip in a parallel, spaced relationship to said second jaw leg so as to receive at least a portion of said flange therebetween, said second jaw tip being formed in such a manner so as to define a second tapered edge which terminates at a second jaw point;

and further comprising a third jaw mounted to said handle and positioned adjacent to said first jaw and facing in an opposed direction with respect to said first jaw.

2. A new sheet metal bending tool for bending a metal flange, said tool comprising:

a handle having respectively opposed first and second ends;

a first jaw member comprising a first jaw leg folded upon itself to define a first jaw tip in a parallel, spaced relationship to said first jaw leg so as to receive said flange therebetween, said first jaw tip being formed in such a manner so as to define a first tapered edge which terminates at a first jaw point;

a second jaw member fixedly secured to said second end of said handle, wherein said second jaw member is oriented at an oblique angle relative to said handle, said second jaw member comprising a second jaw leg folded upon itself to define a second jaw tip in a parallel, spaced relationship to said second jaw leg so as to receive said flange therebetween, said second jaw tip being formed in such a manner so as to define a second tapered edge which terminates at a second jaw point; and;

an angle adjustment means for coupling said first jaw to said handle at various angles relative thereto, wherein said angle adjustment means comprises a circular member fixedly secured at an edge thereof to said first end of said handle; a toothed projection projecting from a center area of said circular member; and a socket fixedly secured to said first jaw member, wherein said socket may be engaged to said toothed projection in such a manner so as to position said first jaw at various angles relative to said handle.

3. The new sheet metal bending tool of claim 2, wherein said first jaw can be positioned at one of sixteen angles.

* * * * *